US009416929B2

(12) United States Patent
Inskeep

(10) Patent No.: US 9,416,929 B2
(45) Date of Patent: Aug. 16, 2016

(54) ROTARY HEAD FLASHLIGHT HEADLAMP

(71) Applicant: Mathew Inskeep, Highland Beach, FL (US)

(72) Inventor: Mathew Inskeep, Highland Beach, FL (US)

( * ) Notice: Subject to any disclaimer, the term of this patent is extended or adjusted under 35 U.S.C. 154(b) by 0 days.

(21) Appl. No.: 14/454,902

(22) Filed: Aug. 8, 2014

(65) Prior Publication Data

US 2016/0040834 A1 Feb. 11, 2016
US 2016/0208991 A9 Jul. 21, 2016

Related U.S. Application Data

(60) Provisional application No. 61/875,884, filed on Sep. 10, 2013.

(51) Int. Cl.
*F21L 4/04* (2006.01)
*F21Y 101/02* (2006.01)

(52) U.S. Cl.
CPC ..... *F21L 4/04* (2013.01); *F21Y 2101/02* (2013.01)

(58) Field of Classification Search
CPC ..... F21L 4/04; F21L 4/045; F21V 19/00; F21V 21/0885; F21V 21/145; F21Y 2101/02
See application file for complete search history.

(56) References Cited

U.S. PATENT DOCUMENTS

| | | | | | |
|---|---|---|---|---|---|
| 2,042,385 | A * | 5/1936 | Boring | B65D 90/00 | 248/229.24 |
| 3,069,539 | A * | 12/1962 | Kidd | A42B 3/044 | 24/3.11 |
| 4,508,249 | A * | 4/1985 | Kotchy | A45F 5/00 | 224/219 |
| 5,097,399 | A * | 3/1992 | Gammache | F21L 4/04 | 362/197 |
| 5,577,697 | A * | 11/1996 | Accordino | F16M 13/02 | 248/206.5 |
| 5,605,394 | A * | 2/1997 | Chen | F21L 4/045 | 362/197 |
| 5,853,241 | A * | 12/1998 | Sharrah | F21L 4/045 | 362/105 |
| 6,283,610 | B1 * | 9/2001 | Alajajian | F21L 4/04 | 362/102 |
| 6,457,841 | B1 * | 10/2002 | Lynch | F21L 4/045 | 362/197 |
| 2002/0159253 | A1 * | 10/2002 | Dalebout | B62J 6/00 | 362/191 |
| 2005/0068767 | A1 * | 3/2005 | Uke | F21L 4/04 | 362/202 |
| 2005/0152134 | A1 * | 7/2005 | Parker | F21L 4/04 | 362/157 |
| 2007/0195520 | A1 * | 8/2007 | O'Brien | F21L 4/005 | 362/191 |
| 2010/0182777 | A1 * | 7/2010 | Van Deursen | F16M 11/24 | 362/184 |
| 2012/0033415 | A1 * | 2/2012 | Sharrah | F21L 4/027 | 362/199 |
| 2014/0198484 | A1 * | 7/2014 | Feustel | F21L 4/00 | 362/105 |

* cited by examiner

*Primary Examiner* — Bao Q Truong

(57) ABSTRACT

A flashlight headlamp is described. The flashlight headlamp has a rotary illuminating head around the main shaft capable of forming a right angle upon illumination.

1 Claim, 5 Drawing Sheets

ROTARY HEAD FLASHLIGHT HEADLAMP

This application claims the benefit and priority of U.S. Ser. No. 61/875,884

STATEMENT REGARDING FEDERALLY SPONSORED RESEARCH

The invention was not made under government contract nor was funded grant money used to fund the research

FIELD

Portable Flashlight Headlamp

BACKGROUND

The present invention relates to flashlight headlamp with a rotary illuminating head. This particular device contains a head that rotates around the main shaft forming a right angle upon rotation while illuminating during rotation. The head of this particular device contains within a high power light emitting diode to be utilized in dark areas as an illumination device.

SUMMARY

The novelty of this invention, is having a flashlight headlamp with multiple angles of rotation with a high power light emitting diode to access difficult to see areas due to darkness or low light visibility. The rotating head have integral steps of rotation guides and stopper for a smooth transition between positions. The flashlight headlamp first position is when the rotary head is in-line with the main body at zero degree angle also called the shaft. During rotation of the rotating head, this particular tool provides several angles of rotation until reaching its complete and final position where the head becomes perpendicular to the shaft forming a ninety degree angle. Users can take advantage of the present invention by having a multi position flashlight.

DRAWINGS

DETAILED DESCRIPTION

The present invention pertains to a new and improved flashlight headlamp with a ninety degree rotary head lamp also including associated powering controls. This particular device contains a head that rotates around the main shaft forming a right angle when turned. This device is also a complete light unit consisting of a high power light emitting diode used as the main lamp. The rotary head mechanism of the present invention forms a complete assembly when coupled to the main body shaft.

Figure 1:
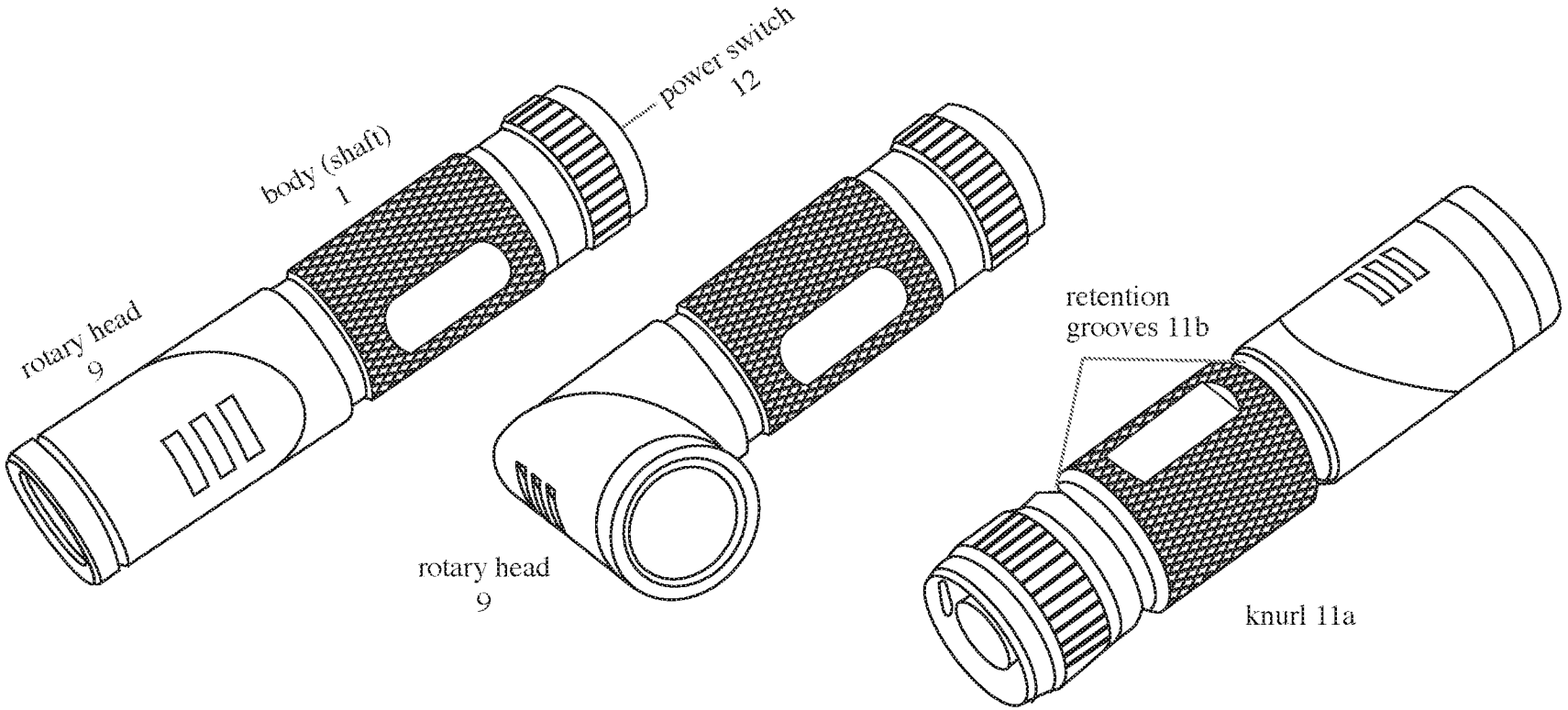
FIG. 1 is a complete view of the present invention that shows the main parts of the invention composed of the rotary head, the main body and the power switch.
Figure 4:
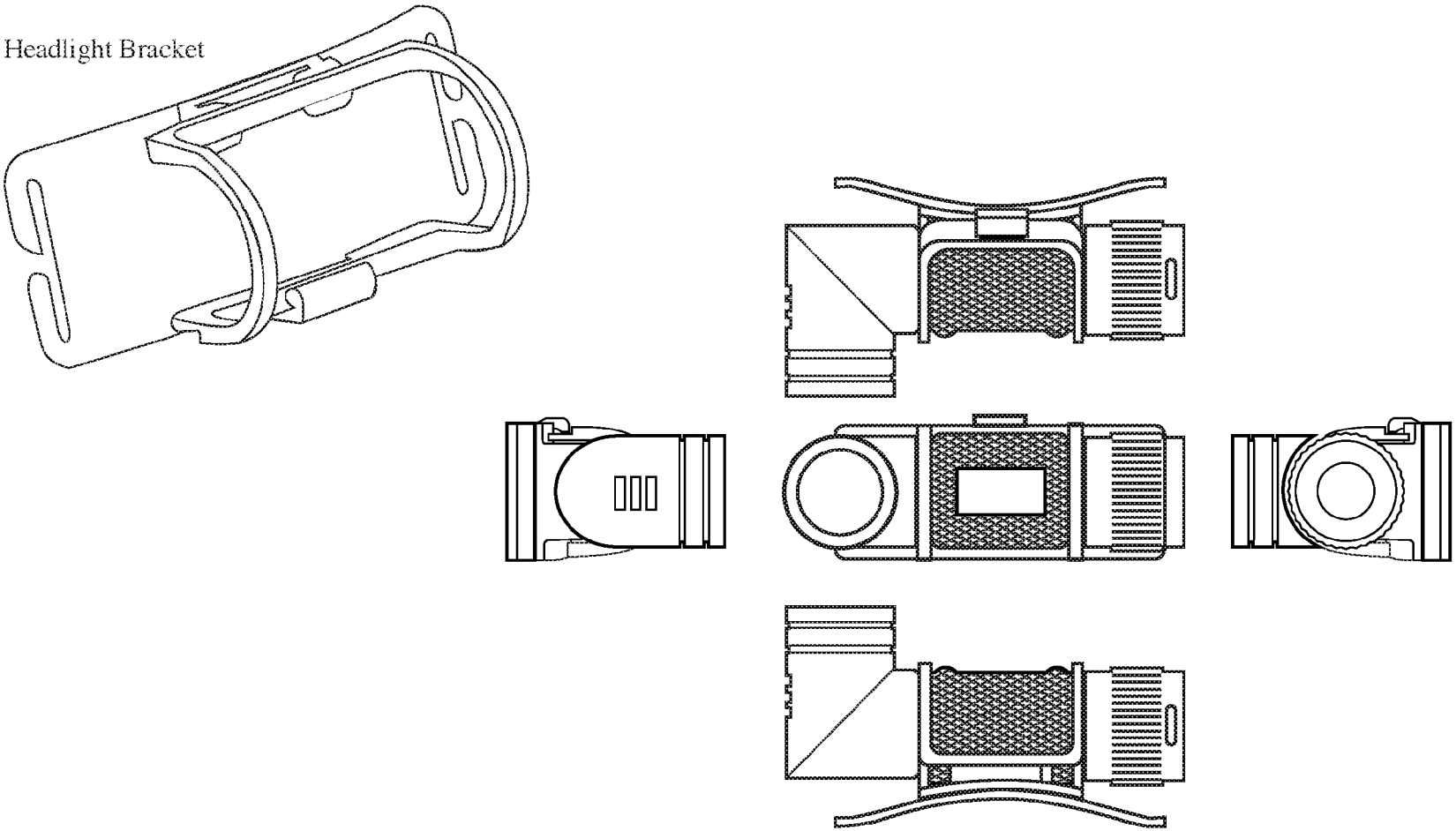
FIG. 4 is an exemplary view of a hands free bracket that could be also utilize to support the flashlight tool during operation.
Figure 5:
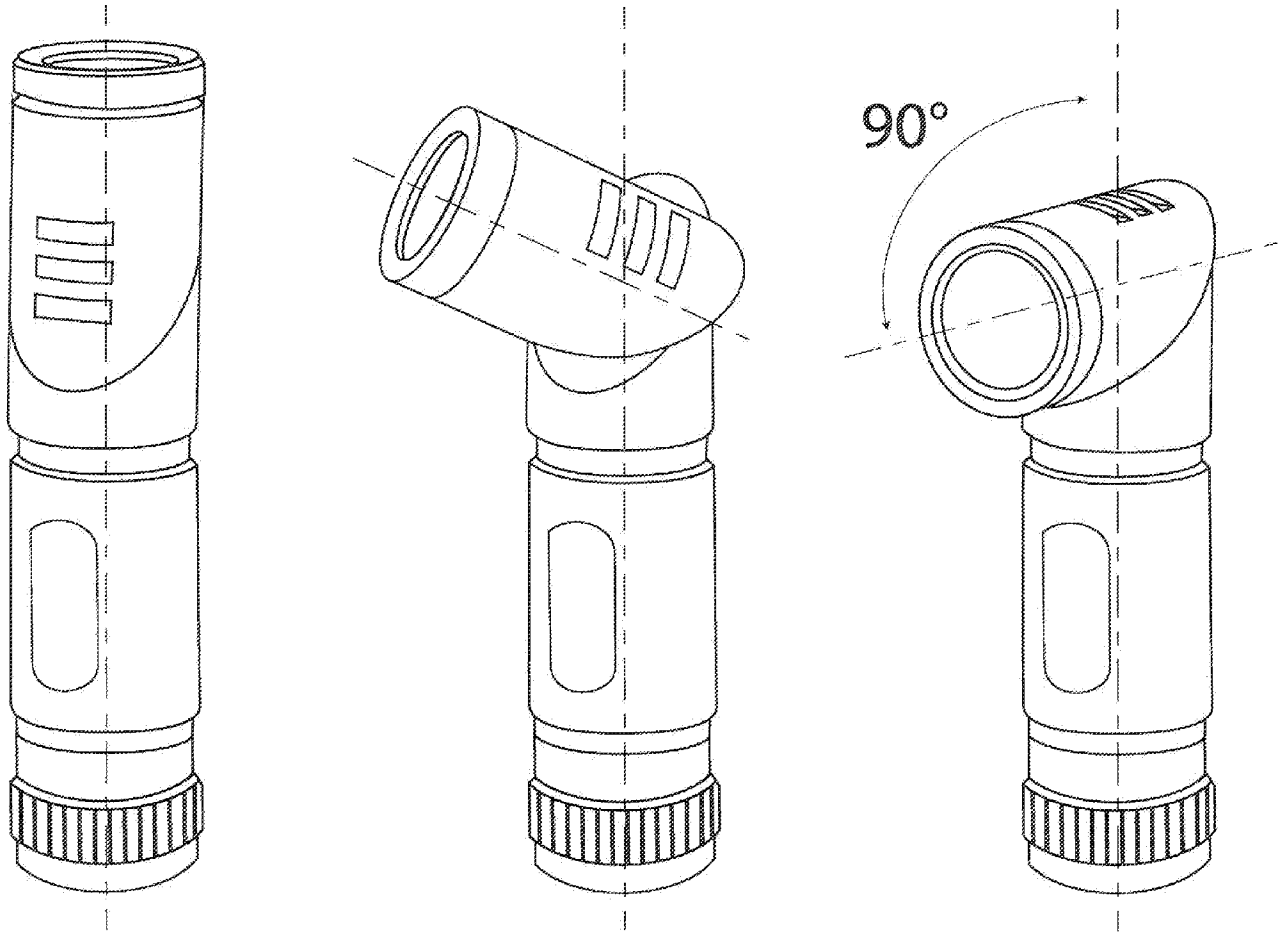
FIG. 5 is a complete view of the present invention that shows the angles of rotation of the flashlight headlamp around its own axis.

FIG. 1 is a complete view of the present invention showing the main parts that make up this flashlight headlamp. The first component is the rotary head 9, which primary purpose is to provide illumination in addition to having an angle of rotation of ninety degree around the axis of the flash light headlamp 15. This feature provides the end user multiple angles of illumination without having to change positions or moving position of the flashlight device, as shown on FIG. 5. As part of the main body, there is also an anti-slip feature called the knurl 11*a*. The main body (shaft) 1 body contains a knurl 11*a* feature which surrounds the main body. This knurl 11*a* provides a secure and comfortable grip to the user when handling, preventing the tool from subsiding from the user's hand. The knurl feature is described in other prior arts and will not be elaborated further. The main body also has a secondary retention features refer on FIG. 1 as retention groves 11*b* located at opposite ends of the main body (shaft) 1. The purpose of these grooves 11*b* are to provide a hands-free operation while working. The preferred method of hands free operation is through a head band bracket as shown on FIG. 4. The external bracket allows the body to rotate freely within the body shaft retention grooves 11*b* and allows for pivoting of the external bracket itself. Additionally, this device is powered by internal user replaceable batteries and activated when the power switch 12 is closed.

Figure 2:
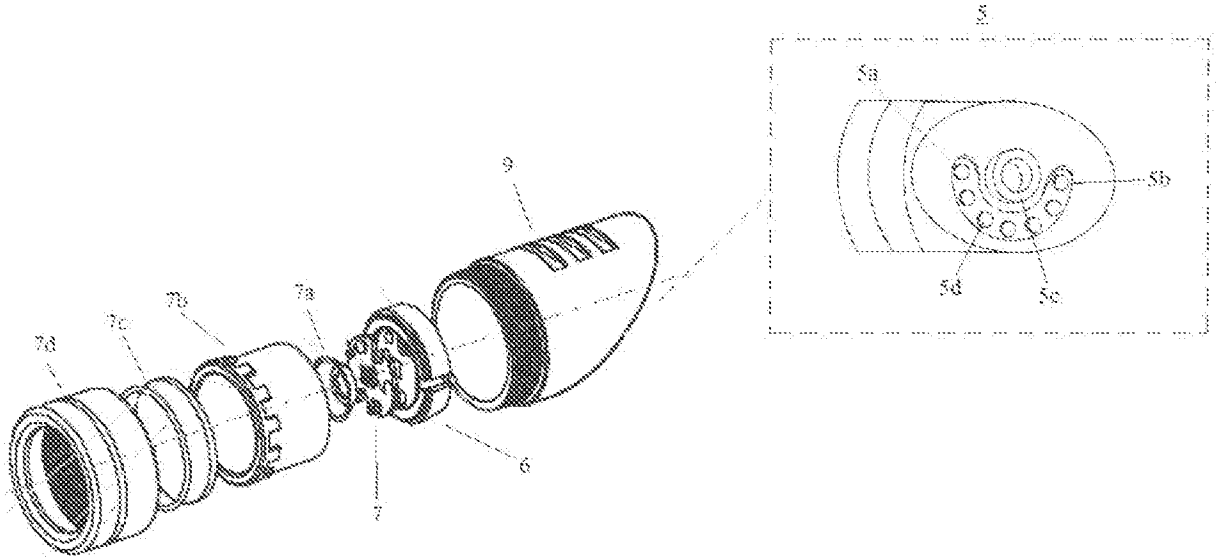
FIG. 2 is a perspective view of the internal construction and mechanical operation of the rotating head lamp.
Figure 3:
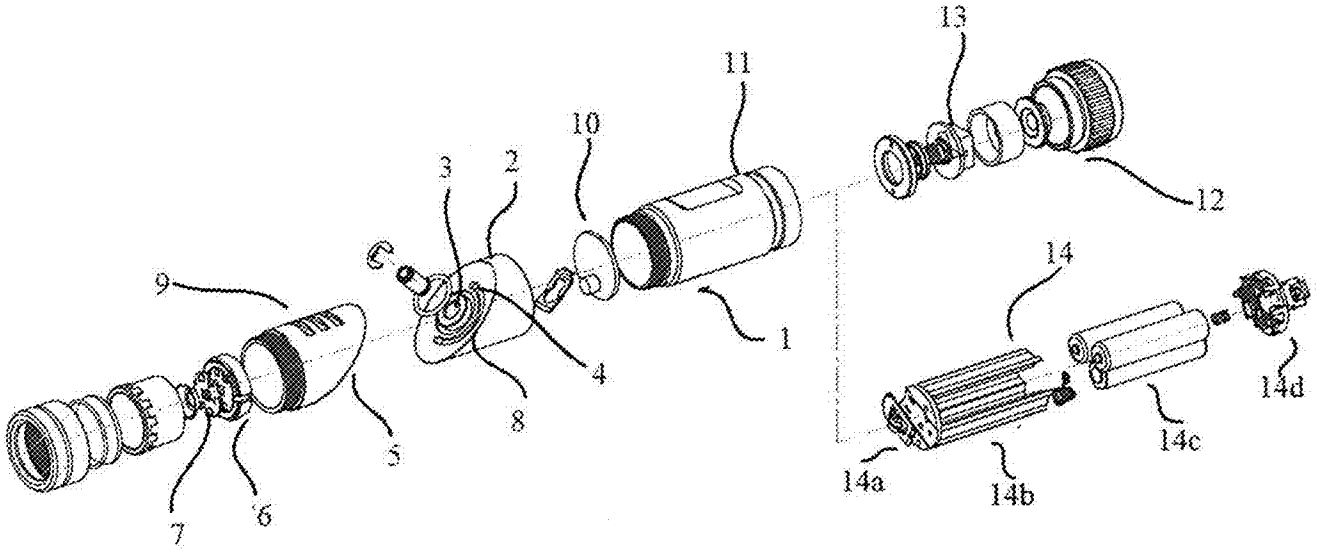
FIG. 3 is an exploded view of the complete unit with details of the internal components.

FIG. 2 is an exploded view of the rotary head 9 features and components. The rotary head 9 consist of a high power light emitting diode 7 used as the main lamp for illumination. The light emitting diode lamp contains around its base a rubber washer 7*a*. This particular washer provides a seal around the base of the lamp to prevent any light from escaping around that area. Once the lamp is powered, the light enters and exits the reflector 7*b* sending the light out through the front bezel and lens 7*d* to the outside world. The front bezel and lens 7*d* are mechanically couple to the rotary head 9 by a threading feature. Additional features are depicted in the rear area of the rotary head 9. These features provide a coupling mechanism to the main body. First, the mating guide stud 5*c* located in the rear center of the rotary head 9, main purpose is to mechanically align and couple the rotary head 9 with the main body (shaft) 1 as shown in FIG. 1. The mating stud 5*c* being plastic, protruding with a certain length, width and height is designed to fit inside the rotating guide 3 receptacle shown on FIG. 3 item number 3. Once the rotary head 9 is aligned and couple with the main body (shaft) 1, the rotary functionality of the rotary head 9 is further expanded by the rotating guide 5*d* and the first position 5*a* feature and the second position 5*b* feature located in the rear adjacent to the mating guide 5*c*. The rotating guide 5 is a feature with a certain depth and a certain groove width that accommodates the rotary stopper 4 on FIG. 3. The utility of the rotating guide 5 is to allow the rotary head 9 to rotate clockwise and counter clockwise on its on axis with a smooth transition between first position 5*a*, and second position 5*b* until a full stop is encountered. The described invention achieves complete stops at zero degree and ninety degree angles when the rotary stopper 4 FIG. 3 collides with the wall of the rotating guide 5*d* at either first or second position. The next sections of this particular embodiment are composed of the mating head 2 and the shaft 1 as shown in FIG. 3, which in conjunction forms the main body in which encapsulates the electrical components of such invention. The shaft 1 has several utility features that collaborate with the invention.

FIG. 3 is an exploded view of the present invention showing all the major electrical and mechanical components that make up the tool. The rotary head 9 was initially described in FIG. 1 and further elaborated on FIG. 2. Additionally, on FIG. 3 the rotary head 9 will be described as a complete assembly part. The rotary head 9 is coupled to the main body (shaft 1) through the mating head 2. There are several mechanical features on the mating head 2 that provide a secure press fit locking mechanism and also the rotating feature for this tool. There is a half circle track 8 that provides a smooth rotation for the rotary head 9, in addition to providing the stopping 4 mechanism at each end. The main body (shaft) 1 includes a printed wiring board 10 that provides an electrical connection between the battery assembly 14 and the main lamp 7 located in the rotary head 9. The printed wiring board 10 also contains a driving circuit that provides the appropriate voltage potential and current level to power the main led 7. The energy source for this flashlight tool is provided by three user replaceable "AAA" 14*c* battery size that are inserted in the battery housing 14*b* and are inserted inside the cavity of the main body (shaft) 1. The battery housing also contains a printed wiring board that provides an electrical connection between the main power switch 13 and the rest of the circuit. The power switch 13 is enclosed inside a metal cap with a threaded feature that serves as the securing and coupling mechanism between the switch 13 and the rest of the flashlight tool.

What is claimed is:

1. A flash light headlamp comprising:

a main body shaft, wherein the main body shaft comprises two retention grooves and each of the retention grooves are located at opposite ends of the main body shaft;

an external bracket with retention bands, wherein the retention bands are suitable for positioning over the retention grooves to attach the external bracket to the flash light headlamp;

a rotary head, wherein when coupled to the main body shaft, the rotary head forms a complete assembly of the flash light headlamp; and a high power light emitting diode integrated in the rotary head.

* * * * *